United States Patent [19]

Ito

[11] 4,259,801

[45] Apr. 7, 1981

[54] DISPLAY DEVICE

[75] Inventor: Reijiro Ito, Tokyo, Japan

[73] Assignee: Kokusai Display Kogyo Co., Ltd., Tokyo, Japan

[21] Appl. No.: 899,566

[22] Filed: Apr. 24, 1978

[30] Foreign Application Priority Data

Apr. 22, 1977 [JP] Japan ..... 52-47125
Apr. 7, 1978 [JP] Japan ..... 53-41422

[51] Int. Cl.[3] ..... G09F 9/00
[52] U.S. Cl. ..... 40/449
[58] Field of Search ..... 40/447, 449, 450, 451, 40/452, 492, 463; 340/378.1, 764, 763, 787, 788; 355/306

[56] References Cited

U.S. PATENT DOCUMENTS

| | | | |
|---|---|---|---|
| 1,765,215 | 1/1930 | Duchard | 40/447 |
| 3,140,553 | 7/1944 | Taylor | 40/449 X |
| 3,426,453 | 2/1969 | Dingwall | 335/306 |
| 3,454,913 | 7/1969 | Israelson | 335/306 |
| 3,460,276 | 8/1969 | Payne | 40/447 X |
| 3,643,311 | 2/1972 | Knetchee | 335/306 |
| 3,721,189 | 3/1973 | Bray | 335/306 |
| 3,916,403 | 10/1975 | Mandzsu et al. | 40/463 |
| 4,115,936 | 9/1978 | Nideikoff | 40/449 X |

*Primary Examiner*—Gene Mancene
*Assistant Examiner*—Wenceslao J. Contreras
*Attorney, Agent, or Firm*—Sherman & Shalloway

[57] ABSTRACT

A display device which can rotate a flap of a display unit in opposite directions in accordance with a predetermined program without necessitating any expensive electronic circuit and switch mechanism. The device comprises a substrate, a flap rotatably supported on the surface of the substrate, a permanent magnet secured to the flap, and a driving magnet located in the rear of the substrate and movable rotative to the substrate. The driving magnet includes an S pole magnetized region and an N pole magnetized region arranged so as to hold the flap at either one of two positions disposed on the substrate.

14 Claims, 17 Drawing Figures

DISPLAY DEVICE

BACKGROUND OF THE INVENTION

This invention relates to a display device which comprises a display unit that can alternately display two kinds of contents to be displayed by means of a flap operative to rotate in opposite directions by the action of a magnet.

Heretofore, it has been well known to provide a display unit that can selectively display either one of two kinds of displays by means of a flap provided with a magnet and rotable between two positions by changing over the polarity of an electromagnet opposed to the magnet of the flap and by rotating the flap from one position to the other position. In addition, a novel display device has been developed in which a plurality of display units are combined into one block and all of flaps are simultaneously rotated in an opposite direction so as to change over the contents displayed, or only those flaps which belong to any desired display unit are rotated in opposite directions so as to display the desired pattern.

However, these well known display devices have the disadvantage that provision must be made of both a memory device and a switch mechanism which are complex in construction in order to select a display unit to be rotated in an opposite direction in response to change of contents to be displayed and to reverse the polarity of an electromagnet of the display unit thus selected.

SUMMARY OF THE INVENTION

An object of the invention, therefore, is to provide a display device which can rotate a flap of a display unit in opposite directions in accordance with a predetermined program and which is simple in construction and reliable in operation.

Another object of the invention is to provide a display device which is substantially not provided with an expensive electronic circuit and not provided with failure induceable switch mechanism and which is thus less expensive and durable.

A further object of the invention is to provide a display device which can produce, on a display surface formed of a number of display units, a display pattern composed of picture elements corresponding to respective display units, respectively.

A feature of the invention is the provision of a display device which, in the simplest form thereof, comprises a substrate, a flap rotatably supported on the surface of the substrate, a permanent magnet secured to the flap, and a driving magnet located in the rear of the substrate and movable relative to the substrate, the driving magnet including an S pole magnetized region and an N pole magnetized region arranged so as to hold the flap at either one of two positions disposed on the substrate. If the driving magnet is moved relative to the substrate, the S pole or N pole region arrives at the rear of the magnet of the flap. As a result, between the driving magnet and the magnet of the flap a magnetic attractive or repellent force is produced which causes either one of two surfaces of the flap to be opposed to the substrate and causes the other surface of the flap to be displayed.

DESCRIPTION OF THE PREFERRED EMBODIMENTS

Figure 1:
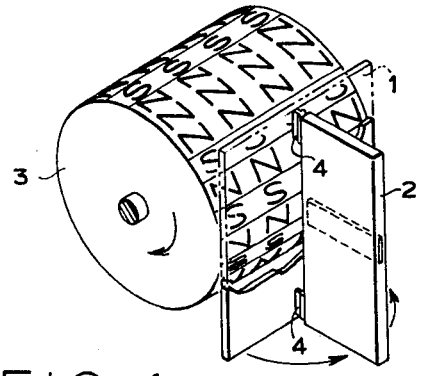
FIG. 1 is a perspective view of one embodiment of a display device according to the invention, main parts being shown partly broken away.

The invention will now be described with reference to various embodiments shown in the drawings. Referring to FIG. 1, reference numeral 1 designates a substrate provided at its vertical center axis with a hinge 4 which rotatably supports a display flap 2. As shown in a greater detail in FIG. 2, the flap 2 is composed of a pair of display plates 2*a* and 2*a'* formed of non-permeable material such as plastics, respectively, and superimposed one upon the other and a plate-shaped magnet 2*b* sandwiched between the display plates 2*a* and 2*a'*. The magnet 2*b* is formed of a usual magnetic material or rubber magnet and is of rectangular shape. It is preferable that the magnet 2*b* has such a length that the magnet 2*b* extends from the center of rotation of the flap 2 to the free end thereof and the magnet 2*b* is so magnetized that one surface of the flap 2 constitutes an S pole and the other surface constitutes an N pole.

Figure 2:
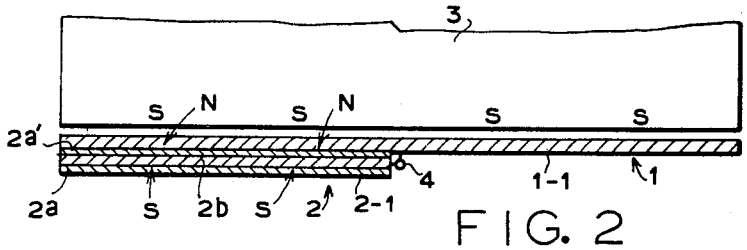
FIG. 2 is a longitudinal sectional view of a part of the device shown in FIG. 1.

The flap 2 is pivoted to the center position of the substrate 1, so that when the surface of the display plate 2*a'* closely makes contact with the substrate 1 as shown in FIG. 2, that surface of the substrate 1 which is located at the right half thereof, that is, a display surface 1-1 is exposed, as well as the surface of the display plate 2*a*, that is, display surface 2-1.

Figure 3:
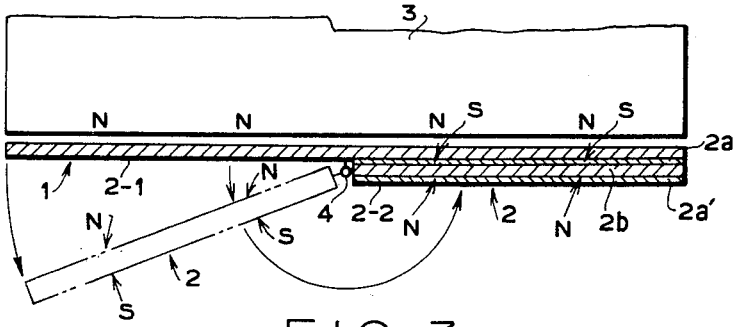
FIG. 3 is a longitudinal sectional view similar to FIG. 2, but showing the device under a condition which is different from the condition shown in FIG. 2.

When the flap 2 is rotated from the position shown in FIG. 2 in a counter clockwise direction by about 180° to a position shown in FIG. 3, that surface of the substrate 1 which is located at the left half of the substrate 1, that is, a display surface 1-2 is exposed, as well as the surface of the display plate *2a'*, that is, a display surface 2-2. The display surfaces 1-1 and 2-1 serve to effect a first display, while the display surfaces 1-2 and 2-2 serve to effect a second display. Let it be assumed that the display surfaces 1-1 and 2-1 are painted in a blue color and that the display surfaces 1-2 and 2-2 are painted in a red color for ease of illustration. As a result, the blue color is displayed under the condition shown in FIG. 2 and the red color is displayed under the condition shown in FIG. 3.

For the purpose of rotating the flap 2 in any direction, the substrate 1 is provided in the rear thereof with a driving mechanism composed of a cylindrical driving magnet 3 formed of a permanent magnet and adapted to be rotated about its center axis in a continuous or a step-wise manner. The driving magnet 3 has a length which is substantially equal to a width of the substrate 1 and is provided around its peripheral surface with a plurality of stripe-shaped regions each having a minimum width which is equal to the width of the magnet *2b*. Each of these regions is magnetized with equidistantly separated N poles or S poles.

FIG. 2 shows a condition under which that region of the driving magnet 3 which is magnetized with the S poles is located at a position opposed to the magnet *2b*. Under such condition, the N pole side of the magnet *2b* makes contact with the substrate 1 and hence is magnetically attracted to the S pole of the driving magnet 3 so as to hold the flap 2 at the position shown in FIG. 2.

If the driving magnet 3 is rotated such that its N pole region arrives at that position opposed to the magnet *2b*, the N pole of the magnet *2b* is magnetically repelled from the N pole of the driving magnet 3 so as to rotate the flap 2 in a counter clockwise direction. Once the flap 2 exceeds the center of its rotary range, the S pole of the magnet *2b* is magnetically attracted to the N pole of the driving magnet 3 so as to closely adhere the surface plate *2a* to the substrate 1, thereby holding the flap 2 at the position shown in FIG. 3. Under the condition shown in FIG. 3, the display surfaces 1-1 and 2-1 which have been displayed are disappeared and the display surfaces 1-2 and 2-2 are newly displayed.

If the driving magnet 3 is further rotated and its S pole region arrives again at a position opposed to the magnet *2b*, the S pole of the magnet *2b* is magnetically repelled from the S pole of the driving magnet 3 so as to rotate the flap 2 in a clockwise direction. Once the flap 2 exceeds the center of its rotary range, the N pole of the magnet *2b* is magnetically attracted to the S pole of the driving magnet 3 so as to closely adhere the display plate 2 to the substrate 1, thereby again holding the flap 2 at the position shown in FIG. 2. That is, every time the driving magnet 3 is rotated and different polarity region arrives at a position opposed to the magnet *2b* of the flap 2, the flap 2 is rotated about the hinge 4, and as a result, the display surface is changed over from the blue color to the red color and vice versa.

In this case, the wider the width of the magnetic pole of the driving magnet 3 the longer the duration of display time. As a result, if the driving magnet 3 is magnetized before hand in accordance with a timing program, it is possible to display for different length of times. Alternatively, the driving magnet 3 may be demagnetized or remagnetized so as to change the display time.

Figure 4:
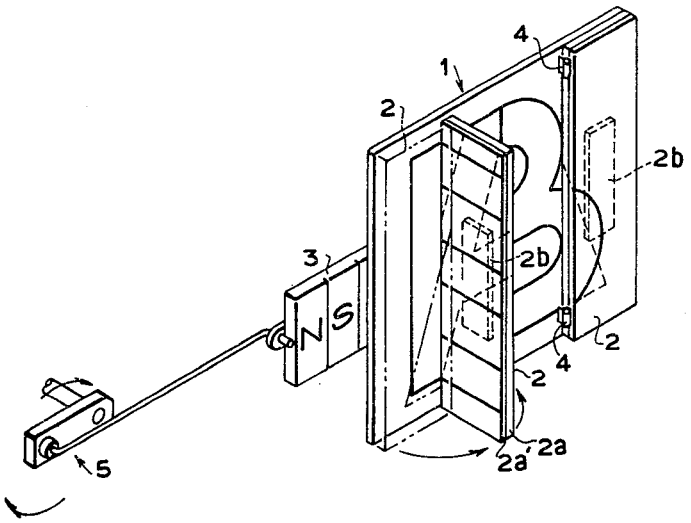
FIG. 4 is a perspective view of another embodiment of a display device according to the invention.
Figure 5:
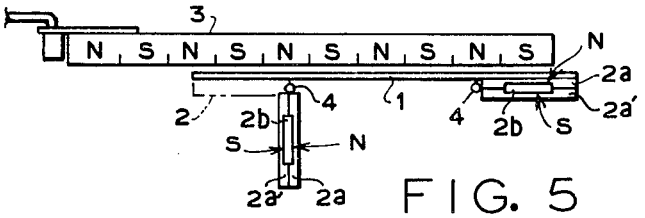
FIGS. 5 and 6 are plan views for explaining the operation of the device shown in FIG. 4, respectively.

FIGS. 4 and 5 show another embodiment of a display device according to the invention. In the present embodiment, use is made of a flat plate-shaped driving magnet 3. Two flaps 2, 2 are rotatably supported by hinges 4 located at two vertical center axes separated from each other by a distance which is twice as long as the width of each of the flaps 2, 2. A magnet *2b* has a length which is about $\frac{1}{2}$ of the length of each flap 2 and is embedded in a center position of each flap 2. The driving magnet 3 is magnetized at regions each having a width which is equal to the width of the magnet *2b* and arranged side by side along the lengthwise direction of the driving magnet 3. The driving magnet 3 is arranged in the rear of the substrate 1 and has one end connected through a connecting rod to a crank mechanism 5 which is operative to reciprocate the driving magnet 3 by a distance which is three times longer than the width of the magnetic pole of the driving magnet 3.

If the crank mechanism 5 causes the driving magnet 3 to reciprocate for the horizontal distance which is three times longer than the width of the magnetic pole of the driving magnet 3, the flaps 2, 2 become rotated to alternately display letters "A" and "B" as shown in FIG. 4. That is, if the driving magnet 3 is moved for a distance which is equal to the width of its magnetized region, the stable position of the magnet *2b* of the flap 2 becomes reversed to rotate the flap 2 about the hinge 4, thereby changing the stable position of the magnet *2b* of the flap 2 to that position on the substrate 1 at which the flap 2 is disposed on the substrate. In other words, the flap 2 is instantaneously rotated in an opposite direction and fallen down on the substrate 1 every time the relative magnetic force between the magnet *2b* and the magnetic pole of the driving magnet 3 becomes unbalanced.

Figure 6:
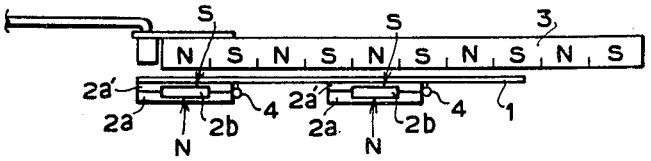

The present embodiment has a feature that the time for displaying the letters "A" and "B" is long when the driving magnet 3 reaches to the limit position of the leftward movement shown in FIG. 5 and to the limit position of the rightward movement shown in FIG. 6 and that the time for displaying the letters "A" and "B" is short at the intermediate between these two limit positions. Such change in the display time is attained by the sine curve change in speed of the reciprocal motion of the crank mechanism 5 and can obtain an efficient advertisement effect by a combination of the time for reading out the advertisement contents and the frequent change of the letters to be advertized in an attractive manner.

Figure 7:
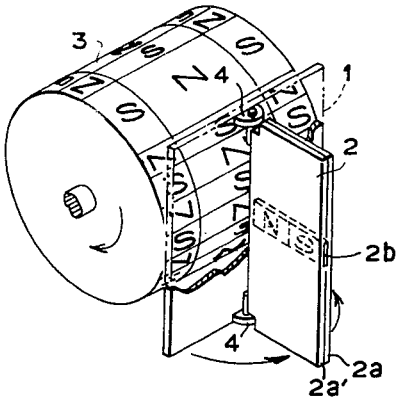
FIG. 7 is a perspective view of a further embodiment of a display device according to the invention.

FIG. 7 shows a further embodiment of a display device according to the invention. In the present embodiment, a magnet *2b* embedded in a display flap 2 is magnetized with N and S poles. That is, the magnet *2b* of the display flap 2 shown in FIG. 1 is divided into N and S pole regions, the N pole region being adjacent to the center of rotation of the display flap 2 and the S pole region being adjacent to the free end thereof. In the present embodiment, the unipolar horizontal stripe-shaped magnetic pole region of the driving magnet 3 shown in FIG. 1 is divided into three pole regions SNS or NSN so as to exhibit the same operation as that exhibited by the embodiment shown in FIG. 1. The display flap 2 is rotatably supported by a bearing portion 4.

Figure 9:
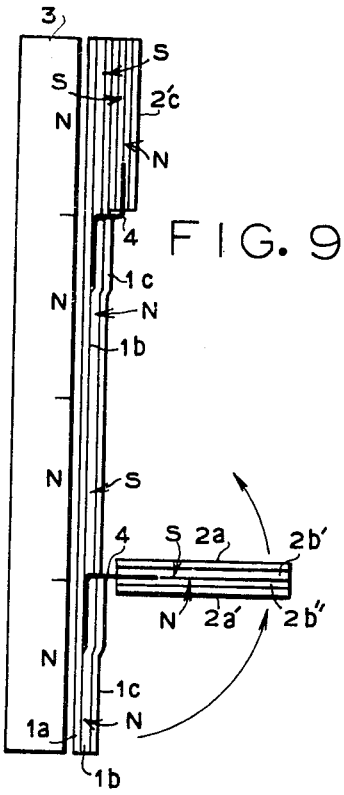
FIG. 9 is a plan view of the device shown in FIG. 8.
Figure 8:
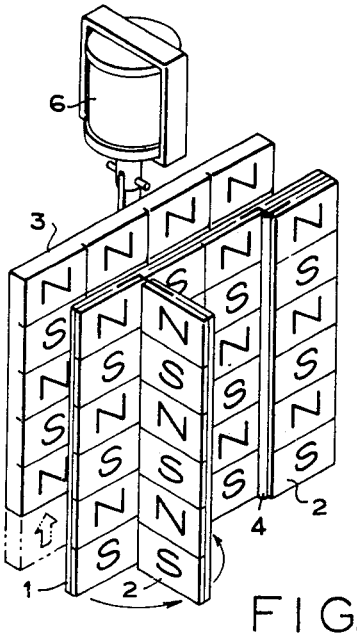
FIG. 8 is a perspective view of a still further embodiment of a display device according to the invention.

FIGS. 8 and 9 show a still further embodiment of a display device according to the invention. In the present embodiment, provision is made of two display flaps 2, 2 and each of these flaps is divided into a number of pole regions. That is, each of these display flaps 2, 2 is composed of two plate-shaped magnets *2b' 2b''* magnetized with alternately different poles in a number of stripe-shaped regions and sandwiched between front and rear display plates 2*a*, 2*a*'. The present embodiment has a feature that a substrate 1 is composed of a magnet 1*b* sandwiched between a base plate 1*a* formed of a plastic film and a display plate 1*c*. The magnet 1*b* of the substrate 1 is divided into a number of poles magnetized with alternately different poles in a number of stripe-shaped regions in the same manner as the magnets 2*b*', 2*b*''. The polarity of the magnet 1*b* and the polarity of the magnets 2*b*', 2*b*'' are arranged such that even when the flap 2 is rotated in either one of two opposite directions, the magnet 1*b* becomes opposed to the magnets 2*b*', 2*b*'' with the same polarity. As a result, if a driving magnet 3 is removed from the rear of the substrate 1, the display flap 2 could not be rotated in either one of the two directions and is held at its position perpendicular to the substrate 1.

In the present embodiment, the driving magnet 3 is of a flat plate-shape and substantially the same in size as the substrate 1. The flat plate-shaped driving magnet 3 is magnetized with the same poles in a horizontal direction, but with alternately different poles in a vertical direction in stripe-shaped pattern. The magnetic force of the driving magnet 3 is made stronger than that of the substrate magnet 1*b*. As a result, if the driving magnet 3 is present in the rear of the substrate 1, the magnets 2*b*', 2*b*'' are magnetically attracted toward the substrate 1 and rotated in either one of two directions. In this case, the holding force of the driving magnet 3 is counteracted by the magnetic force of the substrate magnet 1*b*, but is subjected to substantially total area of the display flap 2, and as a result, the holding force of the driving magnet 3 as a whole becomes considerably strong.

Provision is made of a solenoid 6 which functions to upwardly or downwardly move the driving magnet 3 in the rear of the substrate 1 by a distance between the two adjacent poles thereof. If the solenoid 6 is energized to move the driving magnet 3 upwardly or downwardly by the distance between the two adjacent poles thereof, the polarity of the driving magnet 3 with respect to the polarity of the display magnets 2*b*', 2*b*'' becomes suddenly reversed from the opposite polarity to the same polarity. As a result, the repellent force of the driving magnet 3 together with the repellent force of the substrate magnet 1*b* serve to suddenly rotate the display flap 2 in a direction shown by an arrow in FIG. 9, for example. As descirbed above, the polarity of that substrate magnet 1*b* which is opposed to the opposite side of the flap magnets 2*b*', 2*b*'' is the same as that of the opposed flat magnets, so that the rotation of the display flap 2 toward the substrate magnet 1*b* becomes decelerated. But, the polarity of the driving magnet 3 is the same as that of the flap magnets 2*b*', 2*b*'', so that the display flap 2 is magnetically attracted to and held on the substrate 1.

As described above, the present embodiment makes use of the solenoid 6 for the purpose of raising and lowering the driving magnet 3, so that the display flap 2 is subjected to a shock. In addition, the magnetic force of the substrate magnet 1*b* functions to repel the display flap 2 at its initial reverse rotation. As a result, the present invention is capable of changing over the display at a speed which is relatively higher than the change-over speed of the previous embodiments. In addition, the substrate magnet 1*b* plays a role of alleviating the shock produced when the display flap 2 is urged against the substrate 1, thereby reducing noise. The effect of alleviating the shock of the substrate magnet 1*b* may be improved if it is formed as a rubber magnet. Another feature of the present embodiment is that an advertisement display which requires minute expressions can effectively be revealed if the surface plate 1*c* of the substrate 1 and the front and rear plates 2*a*, 2*a*' of the display flap 2 are made of an art paper or synthetic plastic sheet on which offset printing can be made.

In FIGS. 8 and 9, reference numeral 4 designates a hinge formed of polypropylene film which is highly resistant against bending fatigue and cutting failure. One end of the hinge 4 is sandwiched between the flap magnets 2*b*', 2*b*'' and the other end thereof is sandwiched between the substrate magnet 1*b* and the plastic film 1*a*.

As seen from the above, in the present invention, the driving magnet is moved relative to the flap magnet. As a result, if the driving magnet is made powerful and hence heavy in weight, it is difficult to move the driving magnet. In such a case, the driving magnet may be fixed and the substrate together with the display flap may be moved, whereby the display flap can be rotated in opposite directions in the same manner as in the case of moving the driving magnet.

Figure 10:
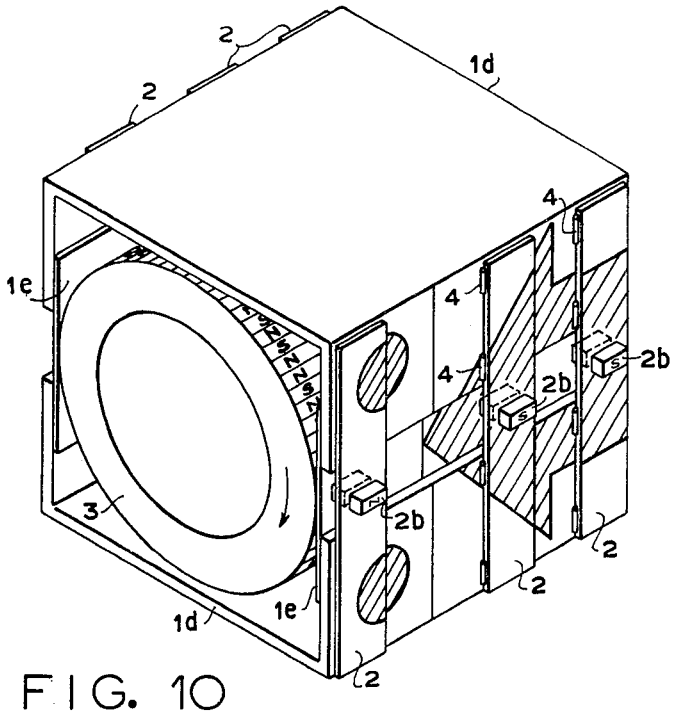
FIG. 10 is a perspective view of another embodiment of a display device according to the invention.

FIG. 10 shows another embodiment of a display device according to the invention. In the present embodiment, each display segment of a display flap 2 in mosaic construction is composed of three sets of display flaps and each set of display flaps is provided at its center portion with a rectangular magnet 2*b* having a small depth and extended through the display flap. A substrate 1 is composed of upper and lower substrate frames 1*d*, 1*d* opposed with and separated from each other by a horizontal groove whose width is wider than the depth of the rectangular magnet 2*b* and through which is extended the rectangular magnet 2*b*. Between the upper and lower substrate frames 1*d*, 1*d* is inserted a driving magnet 3. The upper and lower substrate frames 1*d*, 1*d* are provided at their front side surface with a plastic synthetic paper printed in equally separated regions. At boundaries between the first and second regions, between the third and fourth regions and between the fifth and sixth regions are provided hinges 4, respectively, each formed of a polypropylene film. The display segment of the display flap 2 is composed of two printed front and rear synthetic papers and is rotatably supported by the hinge 4. The substrate frames 1*d*, 1*d* are provided at their opposed inner side surfaces with thin plastic plates 1*e*, 1*e* so as to cover the above mentioned horizontal groove formed between the upper and lower substrate frames 1*d*, 1*d*.

The upper and lower substrate frames 1*d*, 1*d* are also provided at their rear side with the same display flap as that provided at their front side so as to allow to see moving direction of patterns, traffic signal, advertisement decoration or the like to be displayed by the display flaps from two opposite sides of the display device.

A feature of the present embodiment is that the magnet 2*b* provided at the display flap 2 is small in depth. As a result, the peripheral surface of the driving magnet 3 can be divided into a number of transverse stripe-shaped regions. If these regions are magnetized, it is possible to provide a number of combinations, such as, 80 combinations, of the magnetized regions, thereby increasing a memory capacity. In addition, the use of the magnet 2*b* of the display flap 2 having the small depth, that is, a small pole area results in a decrease of the driving force, so that the magnet 2*b* is made elongated and projected into the horizontal groove formed between the upper and lower substrate frames 1*d*, 1*d*.

Figure 11:
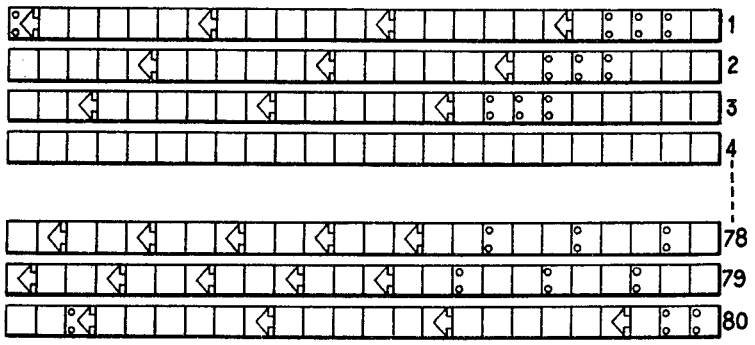
FIG. 11 is a diagram showing the order of changing display patterns produced by the device shown in FIG. 10.

FIG. 11 shows 24 display units composed of 24 display devices shown in FIG. 10, respectively, and arranged transversely side by side. At every step from 1 to 80, each display unit may be displayed or not displayed or a combination of display and non-display of arrow symbol and circle symbol may be changed. Every one step may be effected within a time of 0.25 second and every one period may be effected within a time of 20 seconds. The patterns shown in FIG. 11 may be moved at a high or low speed. In addition, the patterns shown in FIG. 11 may be changed, stopped, forwardly and rearwardly moved or the like without difficulty.

In the present embodiment, a pattern is composed of an arrow symbol and a circle symbol. Alternatively, a color pattern may be moved by displaying or not displaying points. Four different color patterns may be obtained by using the display device shown in FIGS. 4 and 8 which make use of two display flaps and eight different color patterns may be obtained by using the display device shown in FIG. 10 which makes use of three display flaps. These different color patterns may be changed within a period of 20 seconds.

Figure 12:
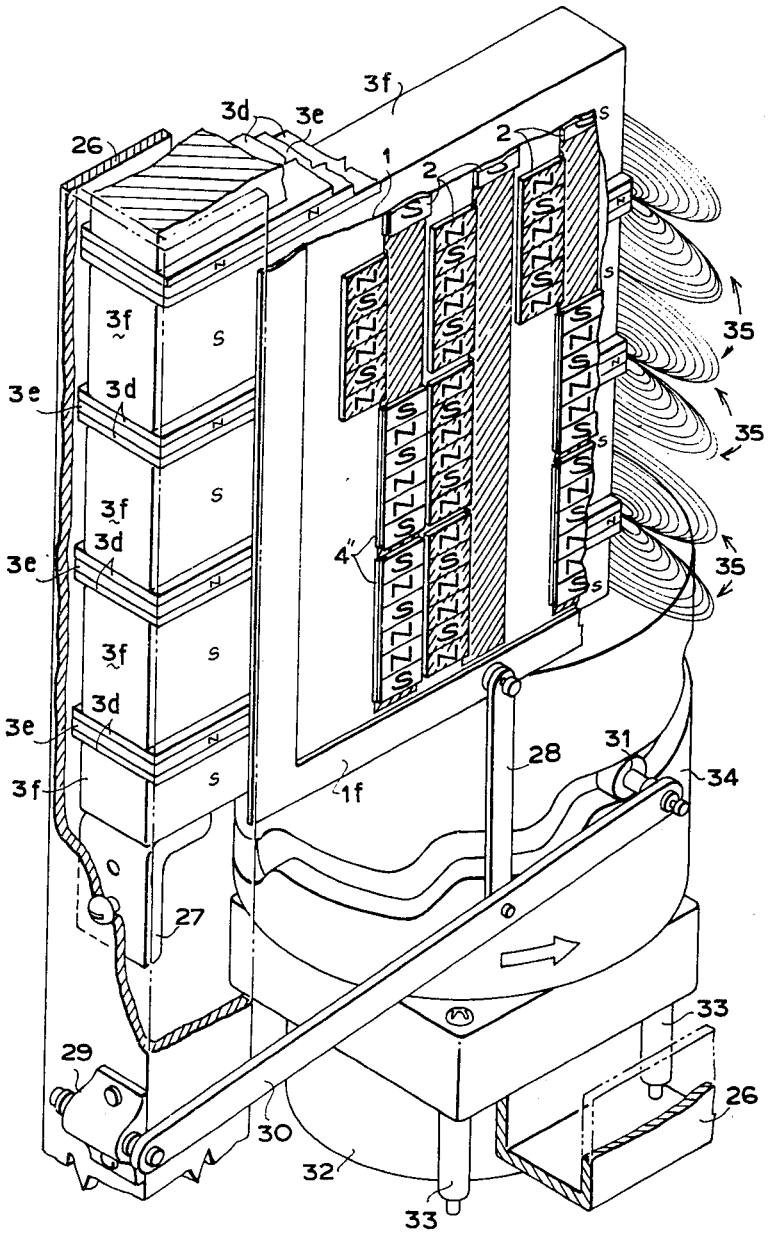
FIG. 12 is a perspective view of a further embodiment of a display device according to the invention, main parts being shown partly broken away.

FIG. 12 shows a further embodiment of a display device according to the invention in which a driving magnet is fixed and a substrate is made movable for the purpose of effecting alternate rotations of display flaps in opposite directions.

In the present embodiment, to a vertical fixed frame 26 which is U-shaped in section is secured a driving magnet block by means of an angle 27 or the like. In front of the driving magnet block is arranged a substrate frame 1*f* adapted to be guided by the fixed frame 26 and to be movable in upward and downward directions. To the lower side of the substrate frame 1*f* is pivoted one end of a connection plate 28 having the other end pivoted to a lever 30 whose one end is rotatably journalled in a bearing 29 secured to the fixed frame 26. The lever 30 is provided at its free end with a rotatable wheel 31. To the fixed frame 26 is secured a motor 32 with a reduction gear by means of bolts 33 or the like. To a reduced speed rotary shaft of the motor 32 is secured a cylindrical grooved cam 34 whose groove engages with the wheel 31 rotatably mounted on the free end of the lever 30.

A feature of the present embodiment consists in a construction of the driving magnet block and a relative relation between a display flap and magnetic poles thereof. The driving magnet block is of fixed construction, so that it is possible to provide a driving magnet block which is powerful and which can produce a vertically narrow magnetic field by using an abundance of magnetic iron material, disregarding an increase of weight.

The construction of the driving magnetic block will now be described in greater detail. The driving magnetic block is composed of a plurality of equally spaced apart and horizontally arranged N pole iron plates 3*e* each having a width which is substantially equal to the inside width of the U-shaped section of the fixed frame 26, two magnet sheets 3*d*, 3*d* each having a N pole surface disposed on and beneath each of the N pole iron plates 3*e*, and a plurality of S pole square iron bars 3*f* each having a width which is slightly narrower than the inside width of the U-shaped section of the fixed frame 26 and sandwiched between the S pole surfaces of the opposed magnet sheets 3*d*, 3*d*. As a result, magnetic lines of force 35 produced from the end surface of the wide area of the magnet sheets 3*d* are concentrated at the narrow end surfaces of the front and rear sides of the N pole iron plates 3*e* and then emitted therefrom, and hence a narrow magnetic flux having a high density is produced from the N poles. On the contrary, the front and rear wide areas of the S pole square iron bars 3*f* are exposed, so that a broad magnetic flux having a low density is produced from the S poles. In addition, the S pole square iron bars 3*f* are arranged inside the end portions of the N pole iron plates 3*d*, 3*e*, so that it is possible to disregard the influence of these S pole square iron bars 3*f* upon the display flap magnets.

A substrate 1 is in contact with the pole surfaces of the N pole iron plates 3*e* and arranged at the front side of the driving magnet block. The peripheral sides of the substrate 1 are adhered to the substrate frame 1*f*. To the substrate 1 are pivoted a group of vertically elongated rectangular display flaps 2 by hinges 4" formed of a plastic film. Each of the display flaps 2 has a length which is substantially equal to the distance between the opposed N poles and is pivoted to the substrate 1 by the hinges 4" which are spaced apart from each other by a distance which is substantially 2 times longer than the width of the display flap 2.

Each of these display flaps 2 includes therein a thin magnet 2*b* whose front and rear surfaces are magnetized so as to provide thereon a plurality of independent poles arranged in a predetermined order in the lengthwise direction of the display flap 2. The surface of each display flap 2 and the substrate 1 are printed with two different kinds of displays as shown by a white blank and hatched lines, respectively. The positional relation between these two kinds of displays is the same as that described in the previous embodiment.

The present embodiment constructed as above described will operate as follows: The motor 32 with the reduction gear functions to slowly rotate the cylindrical grooved cam 34 which causes the lever 30 to move and hence through the connecting plate 28 to upwardly or downwardly move the substrate frame 1*f* and substrate 1. The groove cam 34 is provided with a horizontal groove and an inclined groove. Only when the wheel 31 is rotated along the inclined groove, the lever 30 is moved, but when the wheel 31 is rotated along the horizontal groove, the lever 30 becomes stationary. In addition, the N pole of the driving magnet is located in the rear of some of the plurality of poles of the magnet 2*b* included in the display flap on the substrate 1. As a result, the rotation of the grooved cam 34 causes the polarity (N or S) of those pole regions of each display flap which are located at the third region from the bottom of the six regions to change at the positions where the display flaps are pivoted to the substrate 1 with respect to the white blank surface and hatched lines surface. Thus, different surfaces of the display flaps are held in their stabilized states so as to express a letter T by the hatched lines as a whole.

If the grooved cam 34 is rotated in a direction shown by an arrow and the wheel 31 leaves the inclined groove and arrives at the next lower horizontal groove, the substrate 1 becomes lowered by a distance which is equal to 1/6 of the length of the display flap. At this time, that display flap of which former pole is magnetized with the same pole as that pole of the magnet in the display flap which has been opposed to the N pole of the driving magnet remains in its stationary state (display flaps located at the lowest end of the letter T or the like). That display flap of which former pole is magnetized with the pole which is different from that pole of the magnet in the display flap which has been opposed to the N pole of the driving magnet (display flaps located at both sides of the lowest end of the letter T or the like) is rotated in the opposite direction, thereby displaying a letter U as a whole. In this way, the substrate 1 can be moved upwardly and downwardly along the N poles of the driving magnet so as to display six different kinds of patterns. A feature of the present embodiment is that the use of the cam ensures an elongation of one display and a shortening of the other display and that it is possible to suitably select an interlace movement and order of the display. In addition, the driving magnet block emits from its rear surface side magnetic lines of force in the same manner as in the case of the front surface side. The substrate etc. in the rear of the driving magnet block which are the same in construction as the substrate etc. in front thereof may be connected to a lever. As a result, it is possible to provide a display device which can display in front and rear thereof and which is less expensive. The magnet in the display flap may be magnetized, demagnetized and remagnetized from the front side. In the case of using the present embodiment as a display device adapted to be mounted on the wall, the present embodiment is convenient if compared with the previous embodiment shown in FIG. 1 and provided with the cylindrical type permanent magnet. In addition, the erroneous magnetization of the magnet in the display flap can be discovered by the change of the display, so that the present embodiment is preferable as a display device which requires frequent change of the display.

In the display device according to the invention, a required number of display units each composed of one display flap and a substrate surface having an area which is two times larger than the surface area of the display flap may be closely arranged side by side to provide a display panel which is capable of displaying a desired pattern by rotating a display panel in opposite directions.

Figure 13:
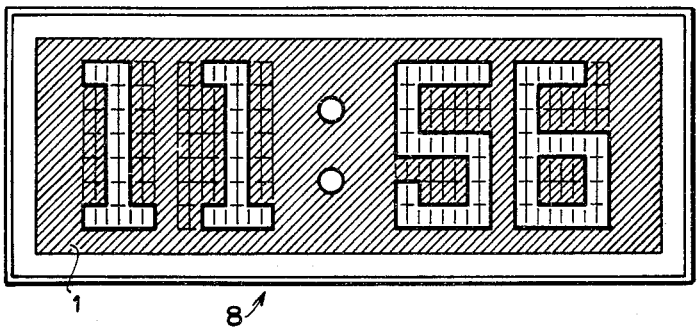
FIG. 13 is a front elevational view of a display device according to the invention constructed as a time display device.
Figure 14:
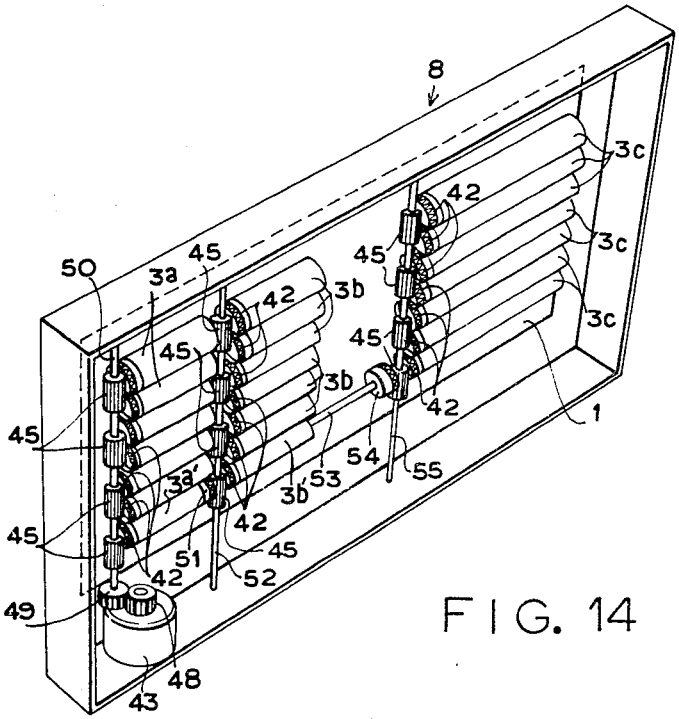
FIG. 14 is a perspective view of the device shown in FIG. 13 viewed from its rear side.

FIGS. 13 and 14 show a time display device composed of the display panel constructed as above described.

In the present time display device, a substrate 1 formed of plastic is secured to an outer frame 8. The substrate 1 is provided at its front side with 28 display flaps, each corresponding to the flap 2 shown in FIG. 1, at the first place of 0 to 9 minutes, with 28 display flaps at the tenth place of the minute, with 28 display flaps at the first place of hour and with 21 display flaps at the tenth place of hour. The substrate 1 is provided in the rear thereof with three blocks of cylindrical driving magnets 3*a*, 3*b*, 3*c*, each block including seven cylindrical driving magnets superimposed one upon the other and arranged horizontally. The first block is arranged in the rear of the first place display of minutes, the second block is arranged in the rear of the tenth place display of minutes and the third block is arranged in the rear of the hours display. Each of these driving magnets 3*a*, 3*b*, 3*c* is provided at its one end with a crown gear 42 secured thereto and having twenty four teeth. Provision is made of a pulse motor 43 adapted to be energized by a signal pulse current supplied from a main time piece and to be rotated step by step for 90°. In addition, provision is made of a vertical driving shaft 50 for the first place of minute connected through gears 48, 49 having a gear ratio of 24:25 to the pulse motor 43 and adapted to be rotated step by step for 86.4°, that is, 0.24 rotation. To the shaft 50 are secured four pinion gears 45 each having ten teeth and threadedly engaged with a crown gear 42 secured to the left end of each driving magnet of the block 3*a* for the first place of minute. The lowest driving magnet 3*a*′ of the first block is provided at its opposite end with one tooth crown gear 51 with twenty three teeth removed and with only one tooth remaining. The crown gear 51 engages with a pinion gear 45 having ten teeth and secured to a vertical driving shaft 52 for the second place of minute and arranged between the driving magnets of the first block 3*a* and the driving magnets of the second block 3*b*. The vertical driving shaft 52 is also provided with the other three pinion gears 45 each having ten teeth. Each of these four pinion gears 45 engages with each of crown gears 42 of the second block 3*b*. In addition, the lowest driving magnet 3*b*′ of the second block is provided at its opposite end with a shaft 53 extending to the right. The shaft 53 is provided at its free end with a two teeth crown gear 54 with twenty two teeth removed and with only two diametrically opposite teeth remaining. The crown gear 54 engages with the lowest pinion gear 45 which is secured to an hour driving vertical shaft 55 which is also provided with the other three pinion gears, each of these four pinion gears having ten teeth. These four pinion gears 45 engage with crown gears 42 of the third block 3*c*, respectively.

If the pulse motor 43 is supplied with a pulse current every one minute, the vertical shaft 50 for driving the first place of minute is rotated step by step for 0.24 rotation. Since the crown gear 42 engaged with the pinion 45 having ten teeth has twenty four teeth, the driving magnets 3*a* of the first block are rotated step by step for 0.1 rotation.

The peripheral surface of each driving magnet 3*a* of the first block is divided into ten regions. These ten regions are magnetized such that the flap magnets rotatably mounted on the substrate 1 and displaying the first place of minute are stabilized at positions for displaying 0 to 9. As a result, the minute displaying numeral becomes changed every one minute. Only when the numerical is changed from 9 to 0, the crown gear 51 of the lowest driving magnet 3*a*′ engages with the pinion gear 45 having ten teeth of the vertical shaft 52 for driving the second place of minute. The four pinion gears 45 having ten teeth engage with the crown gears 42 of the second block, respectively, which cause the driving magnets 3*b* to rotate for 1/12 rotation. The peripheral surface of each of the driving magnets 3*b* of the second block is divided into twelve equal regions. These twelve equal regions are magnetized such that one rotation, that is, twelve steps of the driving magnet 3*b* causes the display flap magnets for displaying the second place of minute arranged in front of the second block to stabilize at a position for repeatedly displaying numerals 0 to 5 in the order of 0 to 5 and 0 and 5. As a result, as soon as the display of the first place of minute is changed from 9 to 0 every 10 minutes, the display of the tenth place of minute becomes changed. When the display of the tenth place of minute is changed from 5 to 0, one tooth of the crown gear 54 secured to the end of the shaft extended from the lowest driving magnet 3*b*′ of the second block becomes engaged with the lower pinion gear 45 having ten teeth and secured to the time driving vertical shaft 55 to rotate it for 0.2 rotation. In addition, the crown gears 42 of the third block engaged with the pinions become rotated for 1/12 rotation. As a result, the peripheral surface of the cylindrical permanent magnets of the third block is also moved by 1/12, thereby changing the numerals of the display flaps arranged in front of the cylindrical permanent magnets. This is because, the peripheral surface of each of the driving magnets 3*c* of the third block is magnetized and thereby twelve different kinds of pole arrangements from 0 to 11 are memorized.

The present embodiment can clearly display numerals on the wall surface even when it is directly exposed to the sun light contrary to the conventional electric lamp display device which can turn on and off display electric lamps with the aid of electric wirings. In addition, the present embodiment can have a thickness which is less than that of conventional mechanical digital display timepieces, so that the present embodiment may easily be seen when it is installed against the wall.

Figure 16:
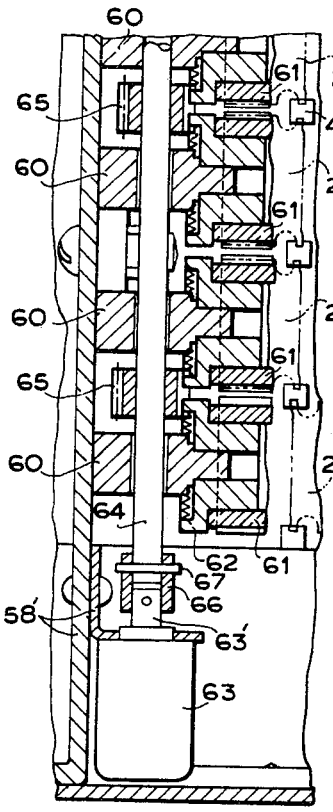
FIG. 16 is a section on line A—A of FIG. 15.
Figure 15:
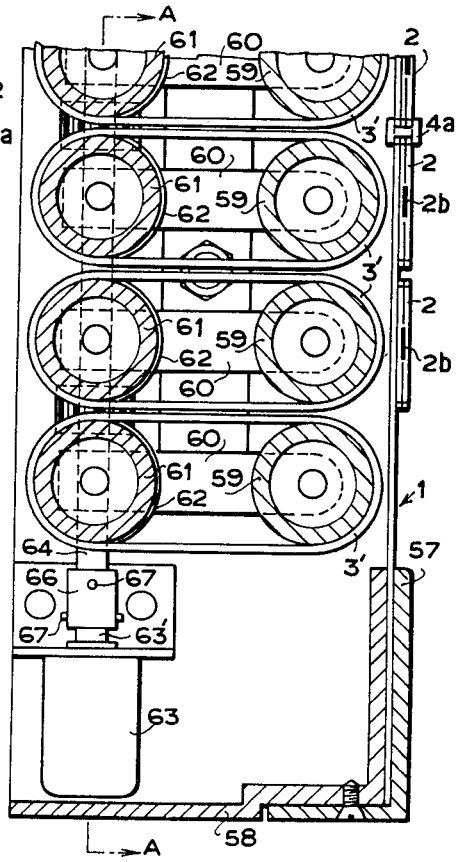
FIG. 15 is a longitudinal sectional view of a driving portion of a still further embodiment of a display device according to the invention.

FIGS. 15 and 16 show a modified embodiment of the display device shown in FIGS. 12 and 13 which can display a number of display patterns.

In the present embodiment, a substrate 1 provided with a number of display flaps 2 is secured through a supporting member 57 to an outer frame 58. The substrate 1 is provided in the rear thereof with a number of rollers 59 each corresponding to each display flap 2 and being rotatably journalled in an inner frame 58' and a bearing portion 60. In the rear side of each of these rollers 59 are rotatably journalled twelve horizontal driving rollers 61. Around the rollers 59 and 61 separated from each other is wound a belt 3' formed of a rubber magnet. To one end of each rear roller 61 is secured a crown gear 62. Each crown gear 62 engages with a spur gear 65 secured to a vertical shaft 64 adapted to be rotated by a pulse motor 63. The pulse motor 63 functions to rotate a motor shaft 63' at a high speed by 45° when it is energized by a pulse produced when a rectangular wave current of 550 mA at 24 V flows for 10 ms. If the pulse motor 63 is supplied with 24 pulses, the motor shaft 63' becomes rotated for 3 rotations. The rotation of the motor shaft 53' is transmitted through a joint portion 16, pin 17, vertical shaft 64 and spur gear 65 to the crown gear 62, thereby effecting 2 rotations of each driving roller 61. This is because of the fact that a gear ratio between the spur gear 65 and the crown gear 62 is 2:3. The 2 rotations of each driving roller 61 results in just 1 rotation of the magnet belt 3', that is, the magnet belt 3' has a length which is equal to 2 times the peripheral length of the driving roller 61. The magnet belt 3' is arranged in the rear of each display flap 2 and provided with independent regions magnetized with poles NSN or SNS in the same manner as the driving magnet 3 shown in FIG. 7. These independent magnetized regions are arranged such that during 1 rotation of the rubber magnet belt 3', the display flap 2 can rotate in the opposite direction at most 24 times. The poles are arranged such that the display flap is held at its stable position when the pole of the rubber magnet rubber 3' is opposed to the pole of the rubber magnet **2*b* embedded in the display flap 2**. The fact that the display flaps constitutes the segments of the mosaic can be held at respective independent positions means that it is possible to display a picture or character representing the mosaic as a whole.

As described above, in the present embodiment, use is made of the rubber magnet belt 3' as a memory element for independently determining the position at which each display flap 2 has fallen down in 24 steps, and as a result, the present embodiment may be applied to a remote control display device such as a railway station display device and can control the number of pulses so as to display any desired pattern selected from 24 kinds of patterns. In FIGS. 15 and 16, reference numeral **4*a* designates a bearing portion provided on the substrate surface and rotatably supporting the display flap 2. Between flanges of the bearing portion 4*a*** are sandwiched plastic plates of the display flap.

The present embodiment has a memory capacity of 24 only. But, if the length of one round of the rubber magnet belt 3' is made long, it is possible to display more than 24 kinds of patterns. In the case of using the present embodiment as an advertisement display device, it is preferable to combine it with an automatic pulse generator for generating 4 to 10 pulses per second and hence to move the display pattern in different directions such as in a neon sign. In this case, the pulse motor 63 may be provided with a reduction gear.

Figure 17:
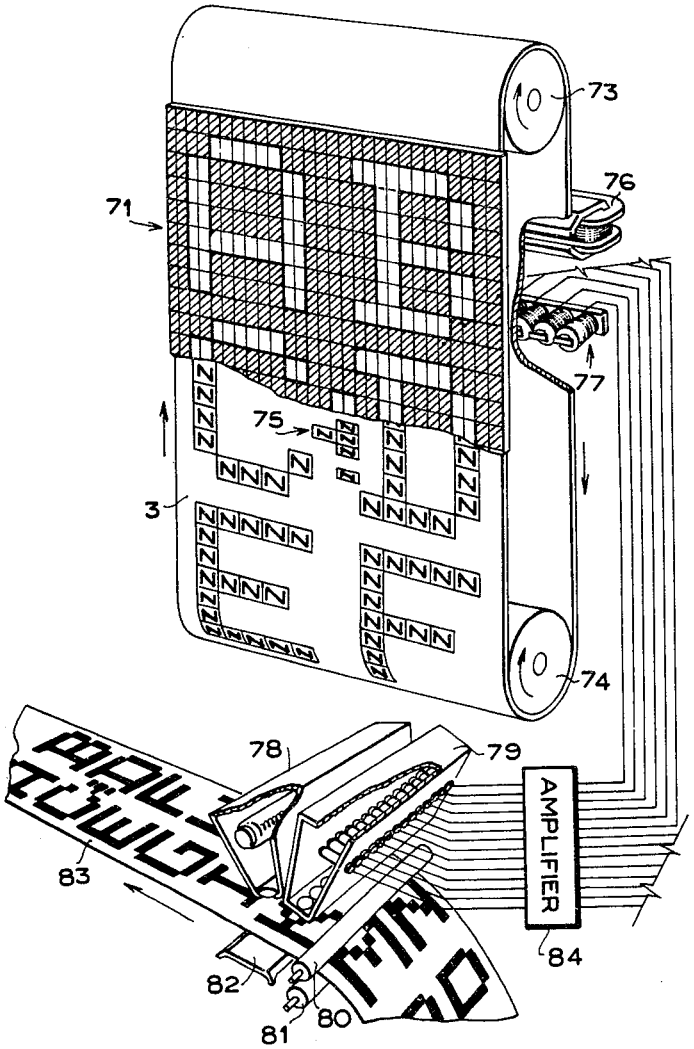
FIG. 17 is a perspective view of another embodiment of a display device according to the invention, main parts being shown by partly broken away.

FIG. 17 shows a still further embodiment of a display device according to the invention. The present embodiment comprises a display panel 71 composed of a substrate 1 and a number of display flaps 2 which are the same as those shown in FIGS. 1 to 3 and a driving magnet 3 arranged in the rear of the display panel 71. The driving magnet 3 is composed of an endless belt formed of a rubber magnet and wound around a pair of rollers 73 and 73 spaced apart from and arranged in parallel with each other. The driving magnet 3 is adapted to be run at any desired speed in a direction shown by an arrow. In the present embodiment, the driving magnet 3 is provided with one region magnetized with N poles by patterns representing letters A, B, C, D, E, F and with the other regions magnetized with S poles. As a result, in the display unit located in front of the N pole regions, the display flap 2 is held under the condition shown in FIG. 2 and displays the blue color, while in the other display unit, the display flap 2 is held under the condition shown in FIG. 2 and displays the red color. That is, the display panel 71 displays on the red background the letters A, B, C, D, E, F in blue color.

If the driving magnet 3 is moved from the above mentioned condition in a direction shown by an arrow, all of the N pole regions move with respect to the display unit. As a result, the display unit under the condition shown in FIG. 3 is changed into the condition shown in FIG. 2, while the display unit adjacent to the above mentioned display unit and located under the condition shown in FIG. 3 is changed into the condition shown in FIG. 2. Such change of condition is effected on all of the display units of the display panel, so that the movement of the driving magnet 3 results in the movement of the letters A, B, C, D, E, F in the direction shown by the arrow, whereby the display effect similar to the conventional electric light news display can be exhibited.

If the length of the magnetized region formed on the driving magnet 3, that is, the length thereof with respect to the travelling direction of the driving magnet 3 is substantially equal to a distance between the magnets **2*b*, 2*b* of the adjacent display flaps 2, 2, as the magnetized region is moved, the display flap 2 which has been fallen down in the opposite direction is returned to its original position. As soon as the display flap 2 is returned to its original position, the display flap 2 adjacent to the above display flap 2** falls down in the opposite direction.

If the length of the magnetized region formed on the driving magnet 3 is shorter than the distance between the magnets 2b, 2b of the adjacent display flaps 2,2, as the magnetized region is moved, the display flap 2 which has fallen down in the opposite direction is returned to its original position. Then, after a short time, the next display flap 2 falls down in the opposite direction. As a result, the use of a proper arrangement of the above described short magnetized regions ensures an adjustment of the timing of changing or moving the display content and provides the important advantage that at least two kinds of display contents can be displayed with the aid of one magnetized pattern. For example, if the magnetized region is formed by a pattern shown by reference numeral 75 in FIG. 17, as the driving magnet 3 is moved, a vertical bar and a transverse bar are alterately displayed on the surface of the display panel 71.

If the present embodiment is used for the purpose of effecting advertisement or notice, the same contents are often repeatedly displayed, so that it is not necessary to change the pattern of the magnetized region of the driving magnet 3. But, if the present embodiment is used for the purpose of displaying information or passages such as news, a number of contents must be displayed. In such a case, it is necessary to change the pattern of the magnetized region succession. In order to satisfy such requirement, the display device shown in FIG. 17 is provided with an eraser 76 for converting the N pole magnetized region on the driving magnet 3 into the same S pole magnetized region, and a writing in magnet 77 for magnetizing a desired uniformly magnetized region of the driving magnet 3 with N poles. The writing in magnet 77 is composed of a number of electromagnet elements having a width which is substantially equal to the width of each display unit of the display panel 71. The writing in magnet 77 functions to magnetize with N pole one portion of that driving magnet 3 which is located in front of each electromagnet element which is supplied with current. As a result, if selected electromagnet elements are supplied with current for a required time when the driving magnet 3 is travelling at a paper speed, it is possible to provide a magnetized region having any desired pattern on the driving magnet 3.

As means for supplying current to the writing in magnet 77, use may be made of a reading out device composed of a light emitting unit 78 including a lamp incorporated therein and a light receiving unit 79 including a number of light receiving elements. The light emitting unit 78 and light receiving unit 79 are arranged above a tape 83 continuously fed from rollers 80 and 81 and passing over a table 82. The tape 83 is provided thereon with patterns to be displayed. As a result, the patterns on the tape 83 cause the light incident on the light receiving elements of the light receiving unit 79 to change and the change of the incident light is delivered as an electric signal from the light receiving unit 79. The electric signal is amplified by an amplifier 84 and then supplied to the writing in magnet 77. As a result, the pattern similar to the pattern formed on the tape 83 is transferred to the driving magnet 3 as its magnetized pattern.

What is claimed is:

1. A display device comprising:

(a) a substrate having a surface;

(b) a plurality of display flaps, each flap having two surfaces, each flap rotatable about an axis located in a plane which is parallel to the surface of said substrate from a first position in which one surface of said flap is opposed to the surface of said substrate to a second position at which the other surface of said flap is opposed to the surface of said substrate, and vice versa;

(c) one of said flap surfaces having S polarity magnetization, the other of said flap surfaces being magentized to a N polarity;

(d) at least one driving magnet means having a longitudinal and lateral dimension and located rearwardly of said substrate, the driving magnet means having a plurality of magnetized thereon;

(e) said one of the driving magnet means being adapted to curve about a generally cylindrical surface in said longitudinal direction;

(f) at least a portion of said one of the driving magnetic means being circumferentially disposed about at least one axis parallel to its lateral dimension, so that at any given time, part of said driving means is circumferentially disposed about at least one of said axis;

(g) said one of the driving magnetic means acting upon more than one of the flaps across the lateral dimension;

(h) said driving magnet means being relatively movable with respect to said substrate and said flaps;

(i) said plurality of magnetized regions of said driving magnet means including S pole and N pole magnetized regions arranged such that when said driving magnet means arrives at a given position with respect to said substrate and said flaps, a magnetic force acting between said magnetized regions of said driving magnet means and said magnet secured to one such flap causes said flap to attain a predetermined one of said first and second positions;

(j) whereby said flap maintains its position when it is in said one position, and changes its position when it is in its other position.

2. The display device according to claim 1, wherein said magnetized regions cover a region whose length is substantially equal to a length of said magnet of said flap from its rotation center to the free end thereof.

3. The display device according to claim 1, wherein said at least one flap is rotatably connected to said substrate by means of a flexible plastic film.

4. The display device according to claim 1, wherein said magnet of said flap has a plurality of polarities which are different from each other in the direction from the rotation center of said flap to the free end thereof.

5. The display device according to claim 1, wherein said driving magnet is of cylindrical one provided on its peripheral surface with a plurality of magnetized regions.

6. The display device according to of claim 1, wherein said driving magnet is of flap plate-shaped one provided on that surface thereof which is opposed to the rear surface of said substrate with a plurality of magnetized regions.

7. The display device according to claim 1, wherein said driving magnet is of endless belt-shaped one provided at its surface with a plurality of magnetized regions.

8. The display device according to claim 1 wherein said driving magnet means comprises a plurality of driving magnets.

9. A display device according to claim 1 further comprising a magnet secured to each such flap for magnetizing the surfaces thereof.

10. A display device comprising (a) a substrate;

(b) a plurality of flaps each flap rotatable about an axis located on a plane which is parallel with the surface of said substrate from a first position at which one surface of said flap is opposed to the surface of said substrate to a second position at which the other surface of said flap is opposed to the surface of said substrate and vice versa;

(c) a magnet secured to said flap and arranged to magnetize one surface of said flap with a S pole and magnetize the other surface with a N pole; and (d) a plurality of driving magnets located in the rear of said substrate and relatively movable to said substrate;

(e) said driving magnet including S pole and N pole magnetized regions arranged such that, when said driving magnet arrives at a given position with respect to said substrate, a magnetic force acting between said driving magnet and said magnet of said flap causes selected one of said flaps to be held at said first position and causes the remaining flap to be held at said second position, an assembly of said flaps held at said first position displaying a desired pattern.

11. A diaplay device comprising (a) a substrate;

(b) a plurality of flaps each flap rotatable about an axis located on a plane which is parallel with the surface of said substrate from a first position at which one surface of said flap is opposed to the surface of said substrate to a second position at which the other surface of said flap is opposed to the surface of said substrate and vice versa;

(c) a magnet secured to said flap and arrange to magnetize one surface of said flap with a S pole and magnetize the other surface with a N pole; and (d) a driving magnet composed of an endless belt, said endless belt being located in the rear of said substrate and opposed to all of said flaps and movable with respect thereto;

(e) said driving magnet including magnetized regions magnetized such that a magnetic force acting between said driving magnet and said megnet of said flap causes selected one of said flaps to be held at said first position and causes the remaining flap to be held at second position and that said regions are magnetized so as to have a polarity which is different from that of the other portions for a pattern corresponding to a pattern to be displayed.

12. The display device according to claim 11, wherein said magnetized region has a length, with respect to the travelling direction of said driving magnet, which is shorter than that of said magnet of said flap.

13. A display device comprising:

(a) a plurality of display flaps;

(b) a movable driving magnet means in which various bits of information are magnetically memorized, the bits being arranged in a line in the direction of movement of the driving magnet means;

(c) each display flap comprising a non-magnetic material and a small permanent magnet affixed thereto, the small permanent magnet being arranged so that one pole of a magent is directed to one side of the flap and the other pole is directed to the other side of the flap;

(d) a pivotally supported suspending mechanism supporting each display flap so as to permit each display flap to rotate substantially 180° about a rotational center thereof, the rotational center being located approximately at an edge of each flap;

(e) a display on one side of each display flap being affected by means of the resultant force of the magnetization of the bits as the bits are positioned adjacent the flap such that in a first stable stop condition, an opposed relationship of opposite poles of the small permanent magnet and one of said magnetically memorized bits of information establish a magnetic attraction between the driving magnet means and one side of the flap and in a second stable stop condition, an opposed relationship of opposite poles of the small permanent magnet and another of said magnetically memorized bits of information establish an attraction between the driving magnet means and the other side of the flap, wherein like poles of the small permanent magent and a magnetically memorized bit of information establishes a repulsive force between the flap and the driving means, thereby causing the flap to rotate about the pivotally supported suspending mechanism to one of said stable stop conditions.

14. The display device of claim 13 wherein a number of said flaps are vertically and horizontally arranged in rows so that a mosaic display can be effected.

* * * * *

UNITED STATES PATENT AND TRADEMARK OFFICE

CERTIFICATE OF CORRECTION

PATENT NO. : 4,259,801
DATED : April 7, 1981
INVENTOR(S) : Reijiro Ito

It is certified that error appears in the above—identified patent and that said Letters Patent is hereby corrected as shown below:

Claim 5, line 2, delete "one" and insert -- and is --
Claim 6, line 2, delete "flap" and insert -- flat --
Claim 11, line 1, delete "diaplay" and insert -- display --

Signed and Sealed this

*Sixteenth* Day of *June 1981*

[SEAL]

*Attest:*

RENE D. TEGTMEYER

*Attesting Officer* *Acting Commissioner of Patents and Trademarks*